US007967056B2

(12) United States Patent
Arvedi

(10) Patent No.: US 7,967,056 B2
(45) Date of Patent: Jun. 28, 2011

(54) PROCESS AND RELATED PLANT FOR MANUFACTURING STEEL LONG PRODUCTS WITHOUT INTERRUPTION

(76) Inventor: Giovanni Arvedi, Cremona (IT)

( * ) Notice: Subject to any disclaimer, the term of this patent is extended or adjusted under 35 U.S.C. 154(b) by 626 days.

(21) Appl. No.: 11/988,331

(22) PCT Filed: Jul. 19, 2005

(86) PCT No.: PCT/IT2005/000413

§ 371 (c)(1),
(2), (4) Date: Jan. 4, 2008

(87) PCT Pub. No.: WO2007/010565

PCT Pub. Date: Jan. 25, 2007

(65) Prior Publication Data

US 2009/0056906 A1 Mar. 5, 2009

(51) Int. Cl.
*B22D 11/16* (2006.01)

(52) U.S. Cl. ..... 164/471; 164/459; 164/476; 164/477; 164/485

(58) Field of Classification Search ..... 164/459, 164/471, 476, 477, 485; 29/527.7
See application file for complete search history.

(56) References Cited

U.S. PATENT DOCUMENTS

| | | | | |
|---|---|---|---|---|
| 3,710,436 | A | 1/1973 | Schoffmann | |
| 5,657,814 | A | 8/1997 | Maebara et al. | |
| 5,832,985 | A | 11/1998 | Pleschiutschnigg et al. | |
| 5,924,184 | A | 7/1999 | Donini et al. | |
| 6,092,586 | A * | 7/2000 | Schonbeck | 164/476 |
| 6,386,271 | B1 | 5/2002 | Kawamoto et al. | |
| 6,978,531 | B1 | 12/2005 | Che et al. | |
| 7,343,961 | B2 * | 3/2008 | Arvedi | 164/452 |
| 2005/0039320 | A1 * | 2/2005 | Thomanek | |

FOREIGN PATENT DOCUMENTS

| | | | |
|---|---|---|---|
| CN | 1132670 | A | 10/1996 |
| CN | 1161009 | A | 10/1997 |
| CN | 1214642 | A | 4/1999 |
| DE | 2 019 700 | A1 | 11/1970 |
| EP | 0 327 854 | A2 | 8/1989 |
| EP | 0 580 062 | B1 | 1/1994 |
| EP | 0 611 610 | A1 | 8/1994 |
| EP | 0 603 330 | B1 * | 6/1996 |
| EP | 0 730 916 | A1 * | 9/1996 |
| EP | 0 761 327 | B1 * | 3/1997 |
| EP | 0 925 132 | B1 | 6/1999 |

(Continued)

OTHER PUBLICATIONS

U.S. Appl. No. 11/988,334, filed Jan. 2008, Arvedi.

(Continued)

*Primary Examiner* — Jessica L Ward
*Assistant Examiner* — Kevin E Yoon
(74) *Attorney, Agent, or Firm* — Flaster/Greenberg, P.C.

(57) ABSTRACT

A process for manufacturing steel long products provides for starting from a continuous casting step with liquid core reduction, followed by induction heating without interruption until the end of a rolling step in a plurality of stands. The blooms or billets subjected to such a process have initial thickness in the range between 120 and 400 mm and a high "mass flow" passing in the time unit at the outlet from the continuous casting, as well as an average temperature in the cross-section which is higher than the surface temperature, being in the core or inner middle region higher by 100° C. than on the surface, that is of about 1200° C. A plant for carrying out such a process is also described.

4 Claims, 2 Drawing Sheets

FOREIGN PATENT DOCUMENTS

Figure 1:
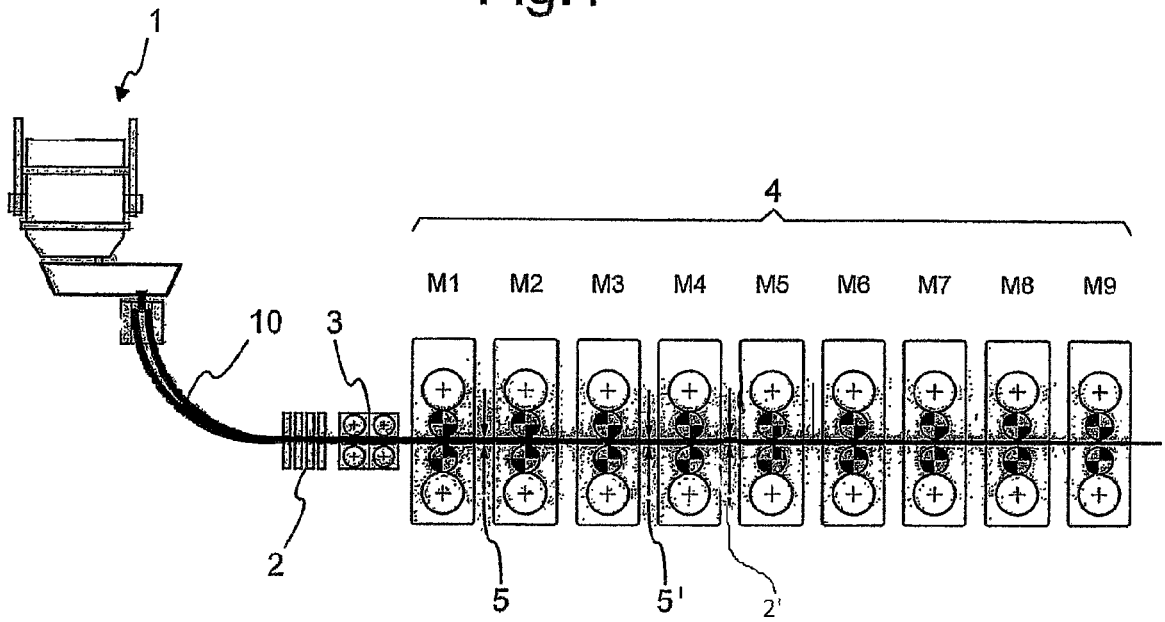

| | | | | |
|---|---|---|---|---|
| EP | 0 946 316 | B1 | | 10/1999 |
| EP | 1 011 896 | B2 | | 6/2000 |
| WO | 92/22389 | A1 | * | 12/1992 |
| WO | 96/01710 | A1 | | 1/1996 |
| WO | 00/71272 | A1 | * | 11/2000 |
| WO | WO 2004026497 | A1 | * | 4/2004 |

OTHER PUBLICATIONS

Xiaoming, Zhang, et al., "Simulation of the Temperature Field during the Transporting Process of the Continuous Casted Slab Rolled Directly", *Journal of Northeastern University* (*Natural Science*), 2001, vol. 22(1), pp. 99-101.

Communication from the Chinese foreign patent office Application No. 2005/80049999.8 on Sep. 7, 2010 with attached English language translation of the text of the Second Office Action, 7 pages.

Communication from the Chinese foreign patent office in non-related Application No. 2005/0049993.0 on Sep. 7, 2010 with attached English translation.

In the United States Patent and Trademark Office, Non Final Office Action, Aug. 20, 2010, U.S. Appl. No. 11/988,334, 9 pages.

* cited by examiner

Fig.2

| | Profile | A=Cross-section area $mm^2$ | R=Reduction % | $\lambda = A_0 / A_1$ |
|---|---|---|---|---|
| | | 62500 (250x250 mm) | 0 | 0 |
| M1 | | 48000 | 23,2 | 1,30 |
| M2 | | 35250 | 26,6 | 1,36 |
| M3 | | 25500 | 27,7 | 1,38 |
| M4 | | 18450 | 27,7 | 1,38 |
| M5 | | 13450 | 27,1 | 1,37 |
| M6 | | 9900 | 26,4 | 1,36 |
| M7 | | 7240 | 26,9 | 1,37 |
| M8 | | 5280 | 27,1 | 1,37 |
| M9 | | 3850 (Ø 70 mm) | 27,1 | 1,37 |

PROCESS AND RELATED PLANT FOR MANUFACTURING STEEL LONG PRODUCTS WITHOUT INTERRUPTION

BACKGROUND OF THE INVENTION

1. Field of the Invention

The present invention relates to a process and related plant for manufacturing the so-called "long" steel products (such as bars, wire, angle irons, beams and rails) without interruption from the continuous casting to the last rolling stand.

2. Description of Related Art

It is known to adopt for this type of production a continuous casting system with one or more lines for manufacturing blooms or billets which, possibly when still hot, feed a rolling mill with a number of stands adequate to the cross-section size of the final product. The finishing rolling can be obtained either by rolling a single billet at a time, or providing a continuous or endless line upon welding together the billet in head-tail succession upstream of the rolling mill. Also other methods are known to obtain an endless production, such as those disclosed in the patent EP 0761327 and in the international publication WO 00/71272, wherein the product from continuous casting is subjected to a temperature homogenization or equalization step throughout its cross-section, than heated and finally rolled in line.

A common feature to all the plants of this type according to the prior art is that the product from the continuous casting (bloom, billet, round bar etc.) undergoes a process of complete homogenization of temperature, in particular throughout the cross-section from the outer surface to the core before being rolled. A complete homogeneity/equalization of temperature between surface and core of the product has been deemed in the past to bring the advantage of a homogeneous elongation of the fibers which, having substantially all the same temperature, would show the same resistance to deformation.

On the contrary a constant technical prejudice has always been that a temperature difference between surface and core of the product would involve a non-homogeneous elongation, such as to affect the quality of the final product.

Still according to the prior art, at least two distinct rolling steps have been deemed to be necessary to obtain the final product, i.e. a first roughing step and a second finishing step, distinct from each other so that the bar to be processed is free from pinching along the whole pass between the two rolling steps.

BRIEF SUMMARY OF THE INVENTION

Therefore the object of the present invention is that of rolling a bloom/billet to obtain steel long products through the greatest possible reduction with the minimum separating strength in favor of the process economy in terms of both lower investment, by employing a total power of the stands lower than that necessary according to the prior art, and of lower power consumption for an identical cross-section size of the final product.

It has been found that, by overcoming a common prejudice of the prior art, as above indicated, these objects can be obtained by placing the rolling mill immediately downstream of the continuous casting, contrary to what has been believed so far. In this way we have a very good solution because the bloom or billet is rolled at an average temperature higher, even when the surface temperature is less than 1200° C. With a temperature at the core of the cross-section being higher by 100-200° C. with respect to the surface temperature, that is of about 1200° C., the advantage is in fact obtained of increasing the average rolling temperature without any problem of product quality and possibility of fire cracks on the rolling cylinders. The increase of average temperature as a consequence of a higher temperature in the core region will allow a surface temperature of less than 1200° C., thus avoiding the above-mentioned problems.

It has also been found that the advantageous effects of this type of rolling directly connected in line with the continuous casting, in other words adopting the so-called "cast rolling" process in this type of manufacturing, are made possible when the cast product:

- has a "mass flow", i.e. the quantity of steel flowing in the time unit from the continuous casting, that is sufficiently high and in particular its speed at the outlet of the continuous casting is >3 m/min;
- is subjected to a process of liquid core reduction ("soft reduction"), e.g. according to the teachings of patent EP 0603330 in the name of the present applicant, in order to ensure a so-called "sound center" of the cast product before being rolled fully solidified, directly in line without interruptions; and
- is made to pass along an induction furnace at the outlet of the continuous casting for equalizing the temperature, not in depth but through the surface layer only, especially to reduce cooling at the corners and to heat further the cast product, whenever necessary, in function of the speed and type of the cast steel.

The above-mentioned objects of the present invention are achieved by means of a process for manufacturing steel long products from a continuous casting step of blooms/billets having a thickness comprised between 120 and 400 mm and a mass flow, wherein a mass flow is a quantity of steel flowing in a time unit at the outlet of continuous casting step of >3 m/min, this step including a liquid core reduction and followed by an induction heating step, without interruptions until the end of a rolling step in a plurality of stands, wherein when entering the rolling step the average temperature of the product is higher than the surface temperature and the difference between the temperature in the core or middle inner region and the surface temperature, which is of about 1200° C., is of at least 100° C. and a plant for manufacturing steel long products from blooms/billets having a thickness comprised between 120 and 400 mm from a continuous casting with liquid core reduction of the casting product, comprising an induction heating furnace upstream of a finishing rolling mill with a plurality of stands, to which said products fed without interruption, wherein at the inlet of the first rolling stand the average temperature of the product is higher than the surface temperature and in the core or inner middle region is of at least 100° C. higher than said surface temperature, which is of about 1200° C., the distance between outlet of continuous casting and rolling mill being not greater than 30 m and at least an additional induction heating furnace intermediate between the rolling stands.

BRIEF DESCRIPTION OF THE SEVERAL VIEWS OF THE DRAWING(S)

These and other objects, advantages and features of the present invention will be clearer from the following detailed description of a preferred embodiment thereof, given by weight of non-limiting example with reference to the annexed drawings.

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 schematically shows an example of plant according to the present invention; and FIG. 2 shows the so-called "rolling schedule" with a profile of the material at the outlet of each respective rolling stand of the plant of FIG. 1.

DETAILED DESCRIPTION OF THE INVENTION

With reference to FIG. 1, an example of plant carrying out the process according to the present invention is shown starting from a bloom 10 leaving a continuous casting zone schematically represented in its whole with 1 and comprising, as is known, a mould, as well as suitable means to accomplish a liquid core "soft reduction". The bloom 10 leaves the continuous casting 1 with a thickness comprising between 120 and 400 mm, e.g. 250 mm, at a speed of about 4 m/min, that means with a high "mass flow".

Then it passes without interruption through an induction furnace 2 and a descaler 3, still without solution of continuity, to the single rolling step carried out with a finishing mill 4.

The finishing mill has been represented here as consisting of nine rolling stands M1-M9 to obtain as final products a round bar with a diameter of 70 mm, as better shown in FIG. 2.

It should be noted that the distance between the outlet of continuous casting 1 and the rolling mill 4 will not be higher than about 30 m, in order to limit the temperature losses of the bloom, thus bringing to the further advantage of having a more compact plant requiring a reduced space. In this way and thanks to the induction furnace 2, the average temperature of the product will result to be higher than the surface temperature with at least 100° C. more at the core than on the outer surface, where the temperature is of about 1200° C. or less.

It will be noted that, by exploiting the above-mentioned greater mass flow, higher reduction can be obtained, and consequently even more compact plants, shorter than 30 m, by using either a planetary mill or a more powerful rolling stand instead of the first (e.g. two or three) roughing stands. Therefore the total number of stands could decrease for example from nine, as it is shown in FIG. 1, to a number as low as seven when the first three stands M1-M3 were replaced by a single stand having three times as much power.

Additional induction heating furnaces (2') between the rolling stands 4 and/or intermediate cooling system 5 placed between to subsequent stands can be further provided according to the casting speed and the type of steel to be rolled.

Finally, with reference to FIG. 2, a practical example of rolling schedule is shown in which, starting from the initial profile of the bloom entering the rolling mill 4, is represented the product profile at the outlet of each single rolling stand. At each profile shown in FIG. 2 there corresponds the cross-section of the product at the outlet of respective stand M1-M9, when beginning with the initial product No. 0 from the continuous casting, having each side of about 250 mm. For each profile there are indicated the value A of the cross-section area; M that is the reduction factor corresponding to $(A_0-A_1/A_0)\times 100$, wherein $A_0$ is the cross-section area at the inlet of the corresponding stand and $A_1$ is the cross-section area at the outlet thereof; as well as the reduction ratio $\lambda=A_0/A_1$.

Thus it can be noted that with nine passes (but even with a lower number of passes) and a reduced amount of the demanded power from a bloom with a side size of 250 mm, a round bar with a diameter of 70 mm of excellent quality can be obtained.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A process for manufacturing steel long products from a continuous casting step of blooms/billets having a thickness comprised between 120 and 400 mm and a mass flow, wherein a mass flow is a quantity of steel flowing in a time unit, corresponding to a speed at an outlet of the continuous casting step of >3 m/min, this step including a liquid core reduction followed directly by an induction heating step, without interruptions until the end of a rolling step in a plurality of rolling stands, wherein when entering the rolling step an average temperature of a product is higher than a surface temperature and a difference between a temperature in a core or middle inner region and the surface temperature, which is of about 1200° C., is of at least 100° C., wherein at least an additional induction heating step is provided, intermediate between at least two of the plurality of rolling stands.

2. The process according to claim 1, wherein a descaling step is provided between said induction heating and the rolling step.

3. The process according claim 1, wherein at least a cooling step is provided, intermediate between at least two of the plurality of rolling stands.

4. The process according to claim 1, wherein the steel long products are bars, wire, angle irons, beams or rails.

* * * * *